US010449467B1

(12) United States Patent
Vaca

(10) Patent No.: US 10,449,467 B1
(45) Date of Patent: Oct. 22, 2019

(54) CONTAINER WITH ENCLOSED MESSAGE

(71) Applicant: Emily Catherine Vaca, Chicago, IL (US)

(72) Inventor: Emily Catherine Vaca, Chicago, IL (US)

( * ) Notice: Subject to any disclaimer, the term of this patent is extended or adjusted under 35 U.S.C. 154(b) by 0 days.

(21) Appl. No.: 15/713,894

(22) Filed: Sep. 25, 2017

Related U.S. Application Data

(60) Provisional application No. 62/400,045, filed on Sep. 26, 2016.

(51) Int. Cl.
*A63H 37/00* (2006.01)
*A63H 33/00* (2006.01)
*B65D 25/08* (2006.01)

(52) U.S. Cl.
CPC ..... *A63H 37/00* (2013.01); *A63H 33/00* (2013.01); *B65D 25/087* (2013.01); *B65D 2577/2041* (2013.01)

(58) Field of Classification Search
CPC ..... A63H 1/32; A63H 3/003; A63H 3/005; A63H 33/00; A63H 33/58; A63H 37/00; A63H 37/005
See application file for complete search history.

(56) References Cited

U.S. PATENT DOCUMENTS 481,448 A 8/1892 Weeks
1,258,464 A * 3/1918 Riley ..... A63H 3/52 446/254
2,093,479 A * 9/1937 Pisacano ..... A63H 1/32 446/253
2,752,816 A * 7/1956 Austing ..... A63F 9/0098 359/522
2,998,896 A 9/1961 Miller
3,220,544 A 11/1965 Lovell
3,434,589 A 3/1969 Valtri et al.
3,696,540 A 10/1972 Ortega
3,983,658 A 10/1976 de Sanz
4,106,657 A 8/1978 Dogliotti
4,124,135 A 11/1978 Weder et al.
4,167,078 A 9/1979 Oquita
4,358,013 A 11/1982 Shebley
(Continued)

FOREIGN PATENT DOCUMENTS

GB 2320221 A * 6/1998 ..... A63H 3/003

*Primary Examiner* — Eugene L Kim
*Assistant Examiner* — Alyssa M Hylinski
(74) *Attorney, Agent, or Firm* — Creativenture Law, LLC; Dennis JM Donahue, III; Kevin Staed

(57) ABSTRACT

The invention is a container comprised of two or more sections that are held together at an interface by one or more joints or seams. Decorative exterior layers can cover or otherwise obscure the seams, or the joints can be obscured or made inconspicuous. Two sections of the container each have a cord that is attached to the exterior side of the sections on opposite sides of the container, and a ring is attached to each cord so that when pulled, the sections of the container separate to reveal the interior of the container. The sections of the container are connected to each other in the interior so when the container is pulled open, the contents in the interior are released while the sections remain connected, and a message banner attached to and extending between the sections is revealed.

20 Claims, 10 Drawing Sheets

(56) References Cited

U.S. PATENT DOCUMENTS

| | | | | | |
|---|---|---|---|---|---|
| 4,499,678 | A * | 2/1985 | Moreau | A63H 3/003 | 40/1.6 |
| D302,192 | S * | 7/1989 | Ansah | D21/463 | |
| 4,873,100 | A | 10/1989 | Dirksing et al. | | |
| 5,127,652 | A * | 7/1992 | Unger | A63F 9/0278 | 273/157 R |
| D434,457 | S * | 11/2000 | Goldman | D21/440 | |
| 7,891,521 | B2 | 2/2011 | Salice | | |
| 8,597,068 | B1 * | 12/2013 | Stathis | A63H 1/32 | 446/253 |
| 9,782,685 | B1 * | 10/2017 | Perez | A63H 33/003 | |
| 2004/0065564 | A1 | 4/2004 | Casey | | |
| 2007/0028494 | A1 * | 2/2007 | Crowell | G09F 11/00 | 40/610 |
| 2010/0203801 | A1 * | 8/2010 | Chan | A63H 1/32 | 446/248 |
| 2010/0223955 | A1 * | 9/2010 | Ramos-Reymann | A44C 11/002 | 63/38 |

* cited by examiner

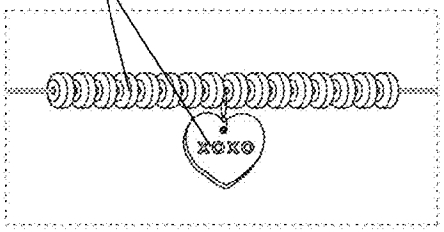
Fig. 3J
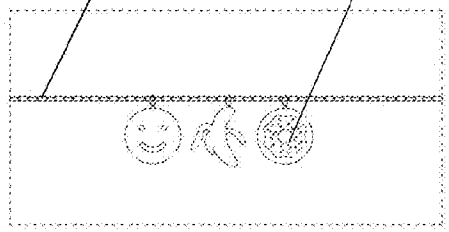
Fig. 3K
Fig. 3L
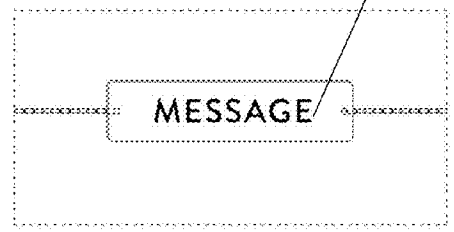
Fig. 3M
Fig. 3N
Fig. 3O
Fig. 3P

CONTAINER WITH ENCLOSED MESSAGE

CROSS-REFERENCE TO RELATED APPLICATIONS

This application claims priority from U.S. Provisional Patent Application No. 62/400,045 filed on Sep. 26, 2016 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a container for holding a message, more particularly to a container where the message is connected to the interior of the container's shell.

Related Art

There have been many designs for a container for holding items, or specifically a message. However, most designs do not retain the items within the shell of the container through the use of a connecting mechanism.

Breaking open a festive container or piñata is a favorite past time for parties around the world. It is most commonly broken apart for an explosion of candy and other treats, in a communal setting, as a group activity. Other important milestones do not use a piñata, or similar container. For this reason, greeting cards are one of the most common ways of delivering a celebratory message to someone near and far, at a party or individually. Greeting cards come in a variety of different arrangements and may have pop-up features, sounds, and even moving elements, but greeting cards are all typically packaged in a flat envelope and lack the festive act of breaking a container open. Traditional piñatas are made of paper construction that are opened by breaking them apart without a way to reclose the piñatas so they are intended for a single use and disposed of after being broken open, which is also not ideal for saving afterwards.

It would be advantageous to combine the benefits of a greeting card that can be opened and closed without destroying the card with the festiveness of opening a piñata. It would also be advantageous if the benefits and festiveness could also serve as a package for items and may be reused as a container.

SUMMARY OF THE INVENTION

A container comprised of two sections and an interior cavity. The container has pull-grips attached to the exterior of the cavity used to pull apart the two sections. Within the interior cavity is a connector attached between the interior sides of the sections holding a message holder that presents messages for viewing when the sections are pulled apart by the pull-grips. Accordingly, the container has a closed configuration with the message hidden from view within the cavity and an open configuration with the sections separated and the message exposed for viewing. The message can be written on, inscribed in, or formed out of a wide range of different substrates and materials.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings which are described in the detailed description below.

DETAILED DESCRIPTION OF THE PREFERRED EMBODIMENTS

The following description of the preferred embodiment(s) is merely exemplary in nature and is in no way intended to limit the invention, its application, or uses.

As generally shown in FIGS. 1-12, this invention combines the fun of a piñata and the message vehicle of a greeting card with an innovative pull-grip system and container construction. This invention allows the user(s) to open the container shell and reveal a message attached within the shell. The flexibility of scalable construction allows for small piñatas to share personal messages to an individual, mini message piñata as party favors for guests, as well as large piñatas to be pulled apart by a group (a la tug of war) to reveal a message for everyone. The container for holding a message 10 is comprised of a shell 12 with two sections 20*a* and 20*b*. The shell has an interior cavity 24, an exterior surface 22*a*, and an interior surface 22*b*. The two sections are connected and configured to be opened using pull-grips that are connected to the exterior surface of the shell.

Figure 3A:
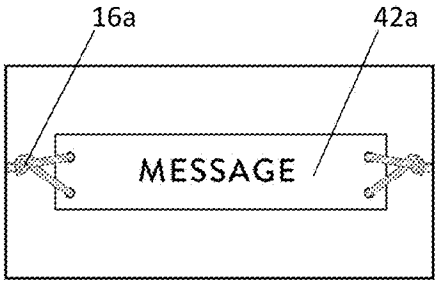
FIGS. 3A-3P are detail views of the message holder used in alternative embodiments of the container invention.
Figure 3B:
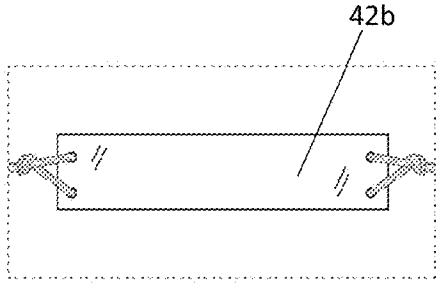

Within the interior cavity is a connector 16 with a pair of ends 32*a* and 32*b* connected at mounts 18*a* and 18*b* on opposite sections of the shell in the closed configuration. The mounts are attached proximate to the ends of the connector to at least one of the interior surface of the shell or a portion of the pull-grips at opposite ends of the connector. When the two sections of the shell are pulled apart using the pull-grips to an open configuration 26*b*, the connector is visible and the message holder 40 attached thereto and described herein reveals a message 42. The message can be customized or prewritten. As disclosed herein, the connector provides a flexible linkage between the sections of the shell. The connector has a message holder attached between its two ends which may be a flexible sheet but may also include one or more rigid components held within the container. For example, the message container may be a small piece of paper with a message written thereon, as shown in FIG. 3A, or the message holder may be made from a plurality of beads, blocks, charms, or other rigid components that are linked together, also depicted in FIG. 3. Accordingly, the rigid components can be linked together about the connector which can be a simple string 16*a*, a chain 16*b*, ribbon, jewelry joint 16*c*, rope 16*d*, or other similarly flexible material.

In the preferred embodiment the message and message holder are pliable elongated strips which are in a folded orientation and have a length that is less than the diameter of the shell and retained within the interior cavity when closed. When the two sections are pulled apart, the elongated strip is unfolded and extends to a length greater than the shell's diameter and the message is visible. The message may be a series of letters 42*h*, jewelry bars 42*i*, charms 42*j*, lockets 42*k*, or similarly rigid materials 42*k* that are connected together by the message holder, such as a linked chain or other fastening means, to form the message. The segmented messages can be folded in the closed configuration and unfolded in the opened configuration.

Figure 1A:
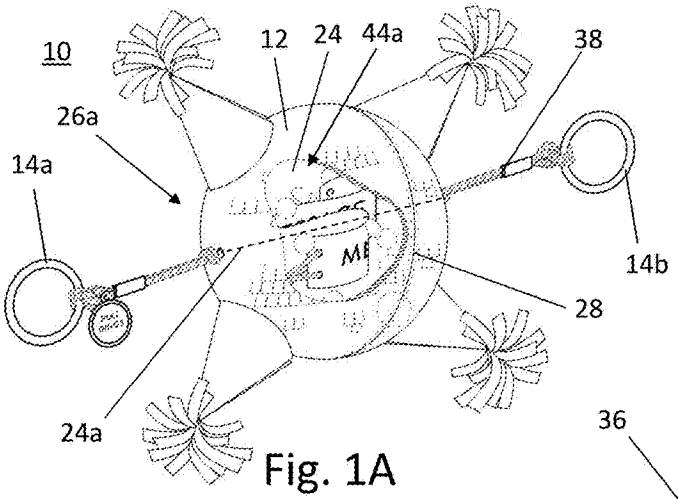
FIGS. 1A-1C are isometric views of the container with an enclosed message according to the present invention in the open and the closed configuration.
Figure 1B:
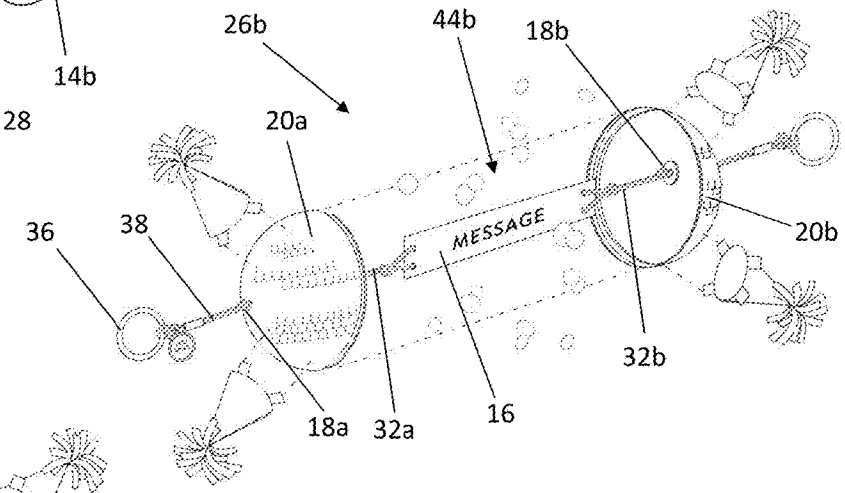
Figure 1C:
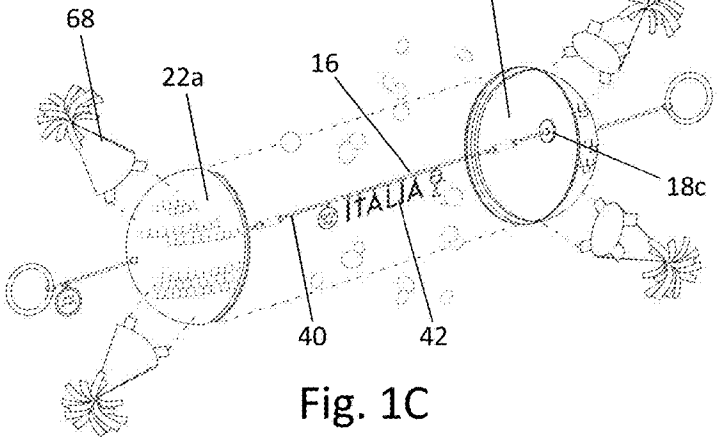

In the closed configuration 26*a* depicted in FIG. 1A, the connector is in a bunched configuration 44*a* and has a length that is less than the diameter of the shell and retained within the interior cavity. Accordingly, the greatest dimension of the connector in the bunched configuration is less than the interior dimension of the cavity of the shell. Generally, the bunched configuration of the connector fits within the interior cavity when the shell is in the closed configuration. When the two sections are pulled apart into the open configuration of the shell, the connector is unbunched and extends 44*b* to a length greater than the shell's diameter as shown in FIGS. 1B and 1C. Generally, the extended connector has a longitudinal distance 46 greater than the size of the cavity 24*a* in the closed configuration and extends between the pair of sections.

Figure 6:
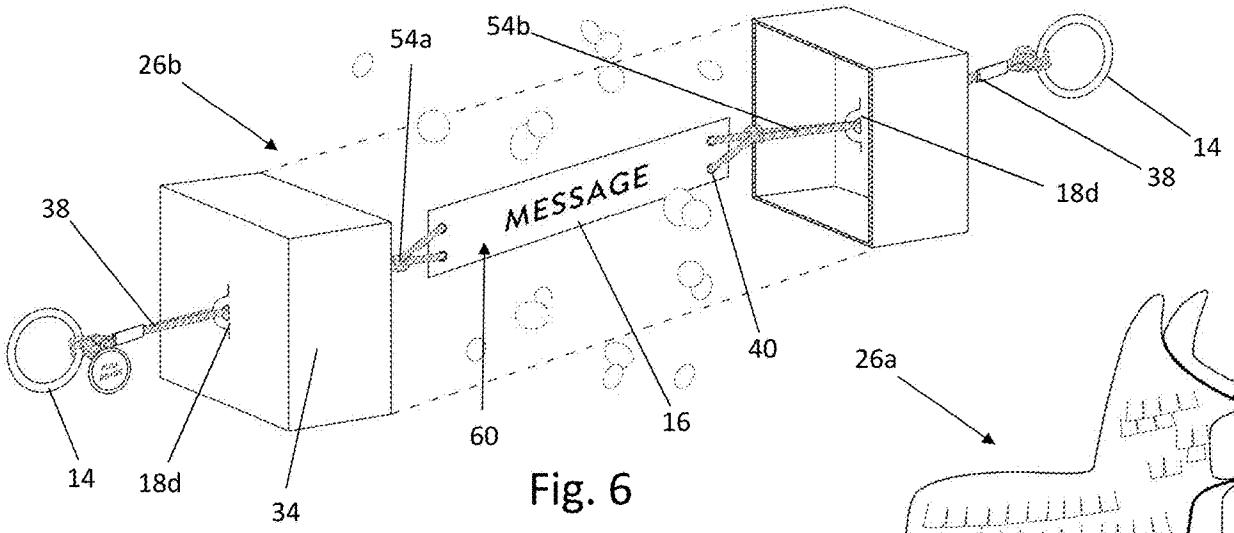
FIG. 6 is a perspective view of a container having a simple geometric shape.

In the preferred embodiment, the pull-grips 14*a* and 14*b* are comprised of a pull ring 36 and a cord 38. The cord is connected to the exterior surface of the shell at one end, and to the pull ring at the other. The container is held by the pull-rings and pulled outward, separating the two sections. The cord of the pull-grips and the mounts within the shell can be one continuous cord that extends through a hole in each of the first and second sections of the shell. The mounts 18 can be a knot 18*a* in the cord and there may be a flange or washer with the knot 18*b* as shown in FIG. 1B. Alternatively, the mount can be a chain with a flange, washer or other bulbous joint 18*c* as shown in FIGS. 1C and 3N or a fixture 18*d* attached to the exterior or interior surface of the container sections as shown in FIG. 6. The cord is preferably knotted on the exterior surface side and the interior surface side to keep the shell in a fixed position on the cord. The washer, flange or bulbous joint are preferably positioned on the interior surface of the hole to provide reinforcement to the shell and distribute the stress to a larger area around the hole when the shell is pulled apart by the pull-rings.

FIG. 2 illustrates a variety of ways the two sections are connected through a joint at their interface in the closed configuration. Additionally, other means for fastening two or more sections together can be used such as adhesives, hook and loop fasteners and other similar connecting means. In another embodiment, the edges of each section abut without any connection means and a decorative seam 30 overlaps both sections and thereby holds the container together in the closed configuration. The seam can cover the edges of the sections and may also be used in combination with the other connection means described below.

Figure 2A:
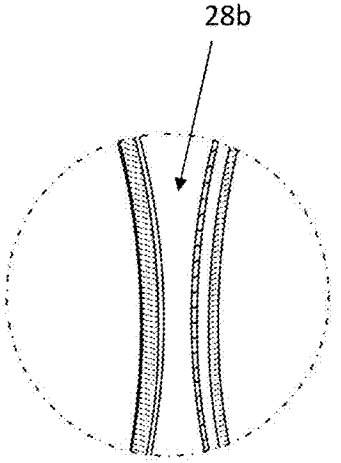
FIGS. 2A-2F are detail views of various embodiments of the connecting interface used for releasably opening and closing the container.
Figure 2B:
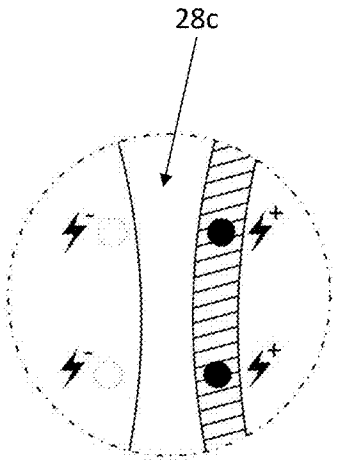
Figure 2C:
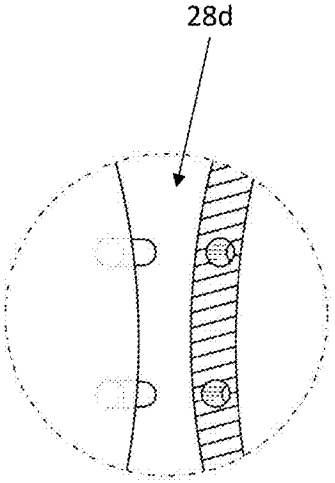
Figure 2D:
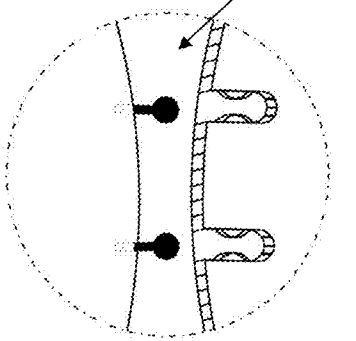
Figure 2E:
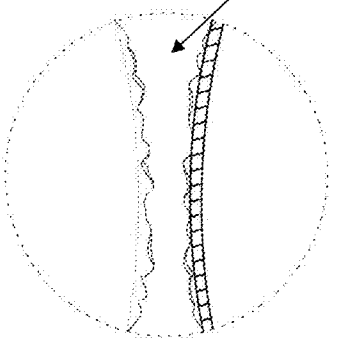
Figure 2F:
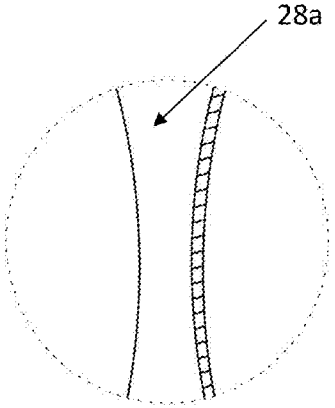

Generally, the interface between the sections in the closed configuration is one or more connection joints. In FIG. 2A, the container utilizes overlapping rims 28*b* for connecting the two sections similar to U.S. Pat. No. 2,998,896 for an Easter egg container. FIG. 2B depicts a magnet along 28*c* the periphery of the sections' edge, while FIG. 2C has pegs on one half and corresponding peg-holes 28*d* on the other to make a male-female connection. Other embodiments connect the two sections using a perforation 28*f* that is torn apart as shown in FIG. 2E, and a fastener mechanism having a catch and latch connection 28*e*, shown in FIG. 2D. Using the connection means or a decorative seam to hold the two sections together, the container can be reused. It is ideal for experiencing over and over as one can pull it apart in the first use and recoil the message to close it again with the sections that fasten together. With its non-destructive nature, this invention can be saved to experience the message inside, just as one would save a greeting card for years to come. However, the sections may also have a non-resealable flat edge connection 28*a*, shown in FIG. 2F, for containers that are not intended to be reused.

Within the interior of the container is a connector attached between the opposite sections by a pair of mounts on opposite sides, proximate to the interior sides of the opposite sections. In either embodiment, the connector presents a message from a message holder when the container is in the opened configuration. In addition to a message holder being attached, the preferred connector has a pair of segments 54*a* and 54*b* positioned relative to the ends of the connector. The first segment 54*a* is attached at its proximal end 56*a* to one shell section and extends away from the shell to its distal end 58*a* where the message holder is attached at one of its ends. Accordingly, the other segment 54*b* connects the opposite section of the shell 56*b* to the opposite end 58*b* of the message holder and the message holder is thereby held within the container in the closed configuration and subsequently presented in the open configuration. When the two sections are pulled apart, the connector becomes taut and the tension 60 caused from such pulling reveals the message on the message holder.

Figure 3C:
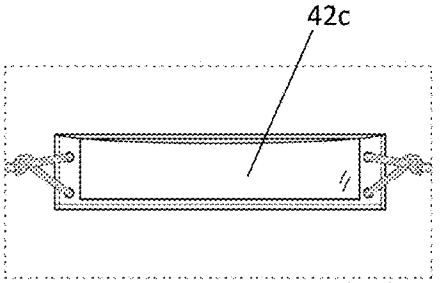
Figure 3D:
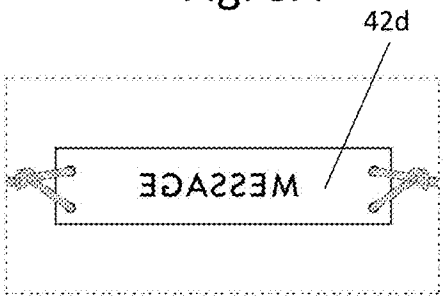
Figure 3E:
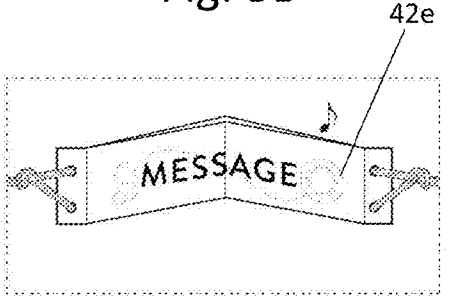
Figure 3F:
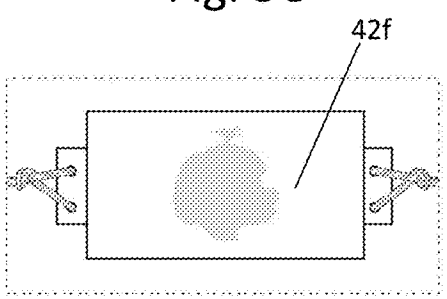
Figure 3G:
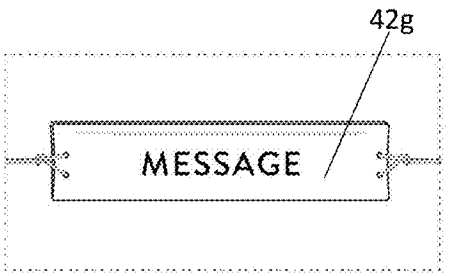
Figure 3H:
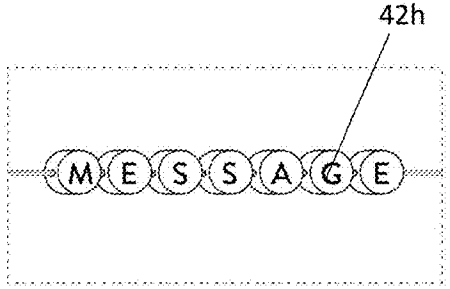
Figure 3I:
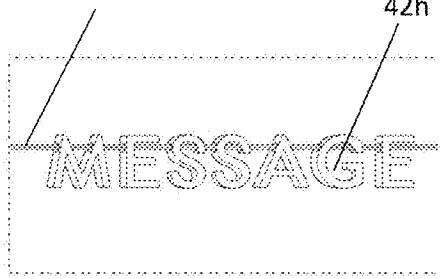

The connector of the present invention in the preferred embodiment is made up of a message holder and a pair of connector segments. In this preferred embodiment the message holder contains a 2D banner 42*a* with a message printed thereon, as shown in FIG. 3A. Similarly, this message holder may also be made up of other elements including but not limited to a rewritable surface 42*b* as shown FIG. 3B, a clear sleeve with a message insert 42*c* as shown in FIG. 3C, a contact paper strip having a transferable message 42*d* in the form of a temporary tattoo as shown in FIG. 3D, detachable banners 42*l* with perforations as shown in 3P, strips with written messages in addition to electronic devices like a musical sound chip that plays a particular song or audio message 42*e* when the container is in the open configuration, messages having graphic designs or photographs, as shown in FIG. 3F, as well as removable slap-bracelets 42*g* such as shown in FIG. 3G. Although the aforementioned message holder embodiments are preferably flexible materials such as paper or soft plastic, other message holders connected between the two segments may be rigid. Such an embodiment with a rigid message holder is shown in FIG. 3J where the message holder is a jewelry bar 42*i*. Of course, this jewelry bar and other non-flexible materials that may be used as a message holder may include but are not limited to gold, silver, stainless, wood or other similarly rigid materials in addition to necessarily rigid electronic devices like lights and audio devices.

In operation the ends of the segments can be attached to opposite sides of the message holder by any number of means, either permanently or removably. As shown in FIGS. 3A-3G one variation has the segments tied to opposite sides of the message holder. Other variations may have jewelry joints like a screw barrel clasp or a spring clasp connecting the message holder between the segments as shown in FIGS. 3N and 3O respectively. Accordingly, any other connection means that adequately connects the message holder to the segments may be used.

In another connector embodiment the connector segments are replaced with a single connector that spans between the two mounts on opposite sides of the shell. In the single connector embodiment the message holders are suspended directly to the connector by various fastening means, such as a hook, linked chain or other permanent or removable means. For example, the message holders in FIGS. 3H, 3I, 3K, 3L and 3M are attached to the connector through mounting holes within the message holders themselves rather than being attached on opposite sides between the pair of segments mentioned above. Accordingly, the messages need not be in the shape of a banner but can also be beaded messages 42*h*, edible charm messages 42*j* as well message container within a locket 42*k*. Conversely, a chain link connector may have a chain link message holder directly connected to the connector. Accordingly, the connector in this embodiment is a single segment attached to one section at one end and the other section at the opposite end.

Users can choose a general message, order custom messages to be printed during construction, or create their own message on customizable versions with blank banners. Options for the user to customize the message on the banner themselves include a blank banner that they can access, customize and hide in the capsule variations that allow for multiple uses. The laminated material in FIG. 3B allows for the message to be written and erased (draw erase marker material, magnetic material that holds magnetic letters, material that can hold repositionable stickers, etc), and the transparent pouch allows for a message to be dropped in and switched out with a new one as illustrated in FIG. 3C.

Although the container may be used without one, the pull-grip is generally shown as a pull-ring connected to a cord. The cord is connected to the shell of the container at one end, while the pull-ring is connected to the cord at the other. A pull-ring provides a user a better grip to pull the two-sections apart.

Figure 4:
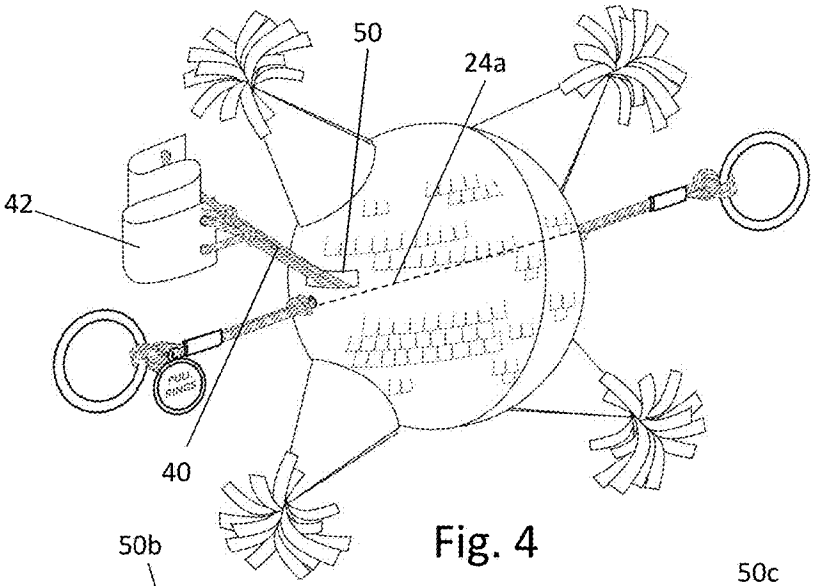
FIG. 4 shows the container with a slit within a sidewall of the container through which a message can be inserted.
Figure 5C:
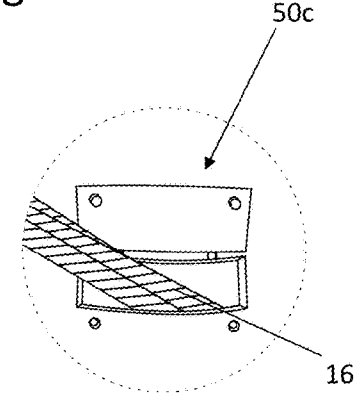
FIGS. 5A-5D illustrate the slit and alternative slit closures.
Figure 5D:
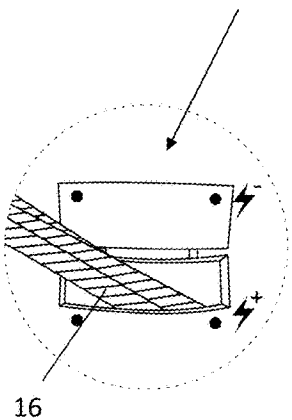
Figure 5B:
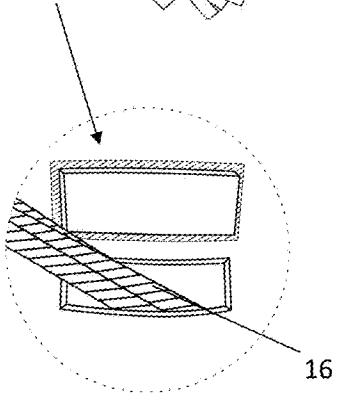
Figure 5A:
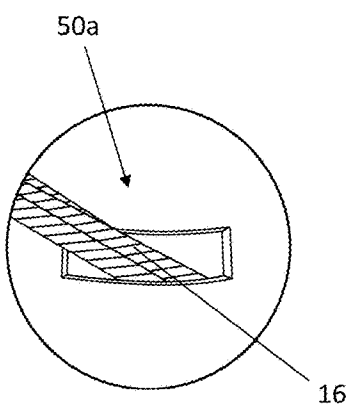

For variations of the shell that do not allow for multiple uses, users can access the message holder to create their custom message through a slit construction 50, shown in FIG. 4, in the shell that allows for the message holder and connector to be exposed initially, customized by the user, and then slipped back into the shell through the slit for the reveal. Any type or size slit may be used; some variations of slits may include but are not limited to a slot in the body to insert the message holder without a seal 50*a* as in FIG. 5A, a slit with an overhanging detachable seal 50*b* as in FIG. 5B, a slit with a hinged seal and peg and hole connection 50*c* as in FIG. 5C, or a slit with a hinged seal magnetic connection 50*d* as in FIG. 5D.

Figure 7:
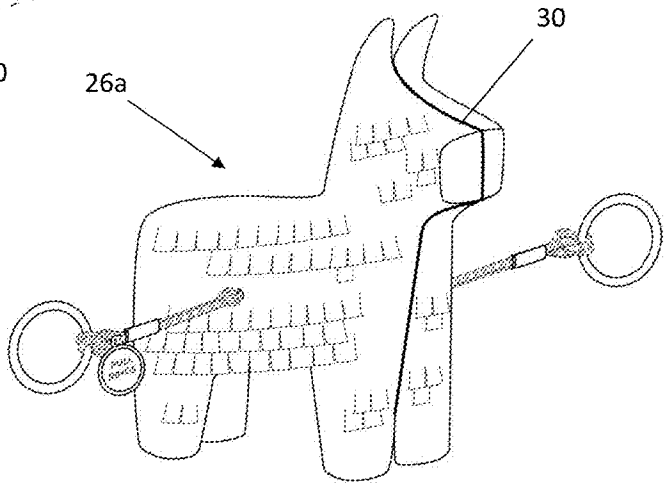
FIG. 7 is a perspective view of a container having a custom molded shape.
Figure 8:
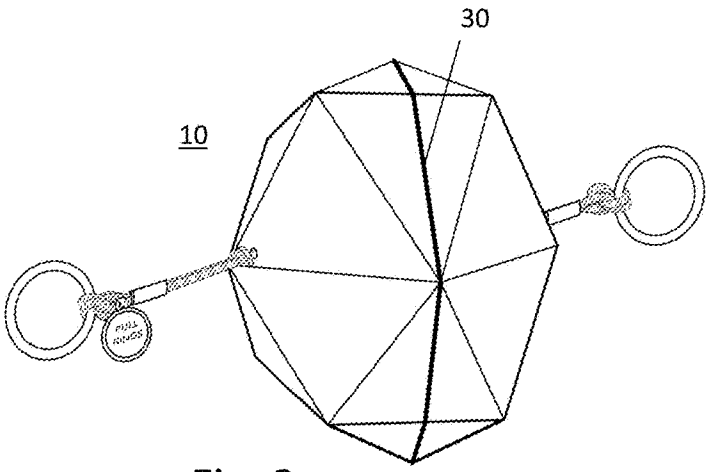
FIG. 8 is a perspective view of a container having a complex geometric shape.

The innovative features, which include a capsule shell with seam that separates and the cording pull system to open it revealing the attached message banner, can be applied to countless modifications of the other elements of the piñata for a variety of evolutions. These include, but are not limited to, modification to the shell shape and material, as the sphere shape is not imperative to the function of the construction. Additional shapes, such as cubes as shown in FIG. 6 or custom molded shapes as shown in FIG. 7 or polyhedrons as shown in FIG. 8, can also work as the shell. It will be appreciated that the construction of these alternative shaped containers can incorporate the different features generally described above, such as the fixture 18*d* as shown in FIG. 6 in which the internal cord segments 54*a*, 54*b* are used as a part of the connector and the external cord segments 38 respectively extend between the external mounts and the corresponding pull rings. As indicated above with reference to FIG. 2, the interface joint between the container sections may be exposed and inconspicuous, such as the seam on a plastic Easter egg, and as shown in FIG. 6, or it may be covered or otherwise obscured by decorations as shown in FIG. 7, or one or more joints can be concealed by the features of the container as shown in FIG. 8.

Figure 9A:
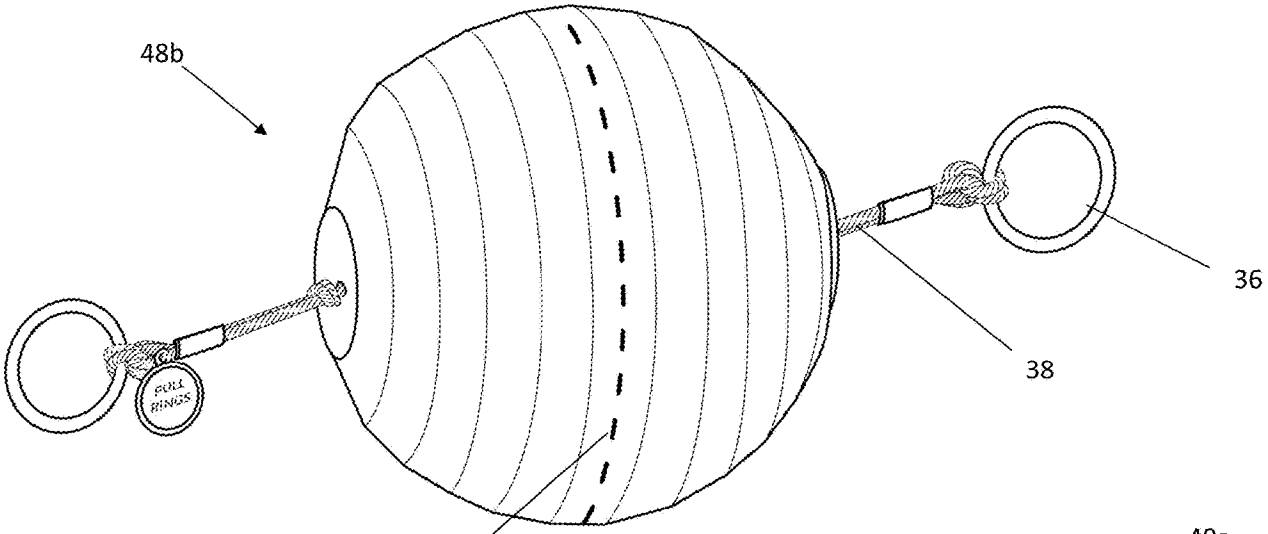
FIGS. 9A and 9B show perspective views of a collapsible container in an expanded configuration and a collapsed configuration, respectively.
Figure 9B:
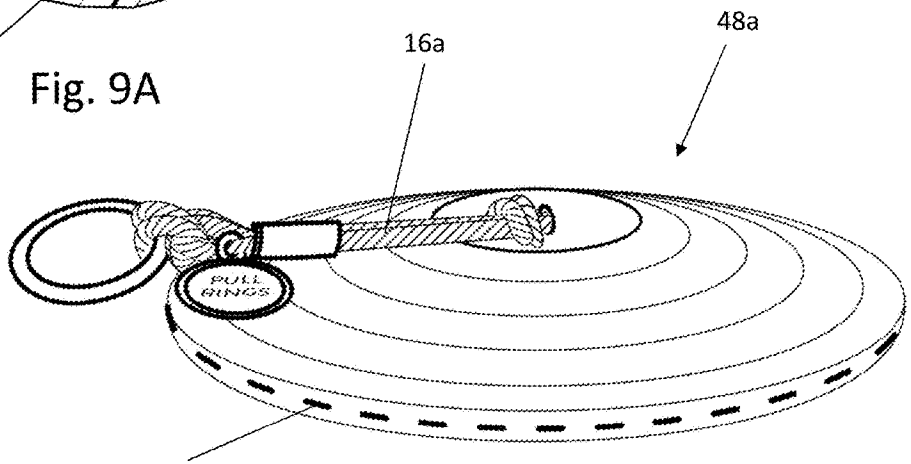

For occasions when the volume of the rigid shell 24*b* cannot be accommodated, such as when sending in the mail via a flat envelope, pliable or otherwise collapsible shells are also available to hold the innovative connector and message banner system. FIGS. 9A and 9B show a collapsible construction option with a multi-piece construction of pliable material that can be folded on itself. For example, a multi-ring construction of concentric rings that fit within each other creates a framework that can be collapsed together, and the framework is covered by a pliable exterior material, such as a paper sheet or a plastic film. Decorative exterior elements can be added and designed to also fold flat 48*a*. The shell takes on its full shape 48*b* when pulled from the flat enclosure through either magnetic connections or a perforated center 28*f*, and then popped open to exposed the interior message banner when pulled with additional force.

Figure 10A:
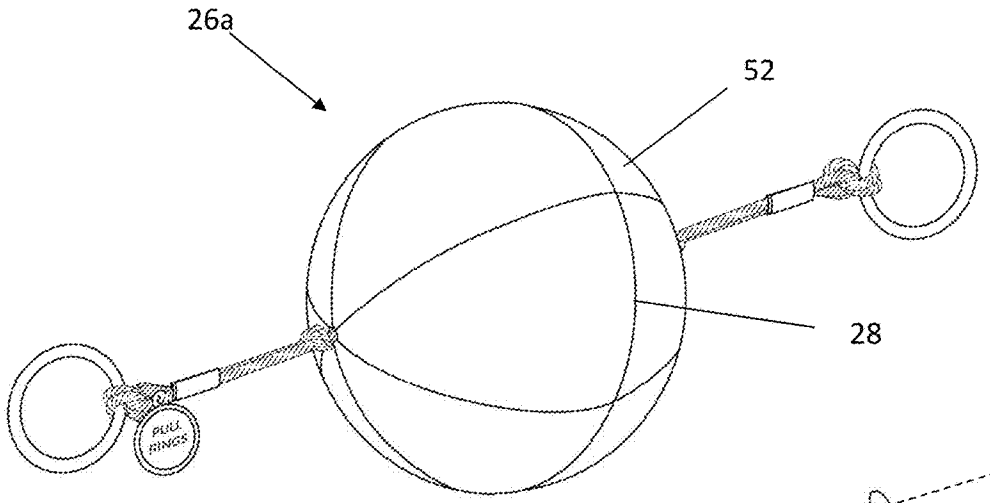
FIGS. 10A and 10B show perspective views of a container having a segmented piece construction in the closed configuration and open configuration, respectively.
Figure 10B:
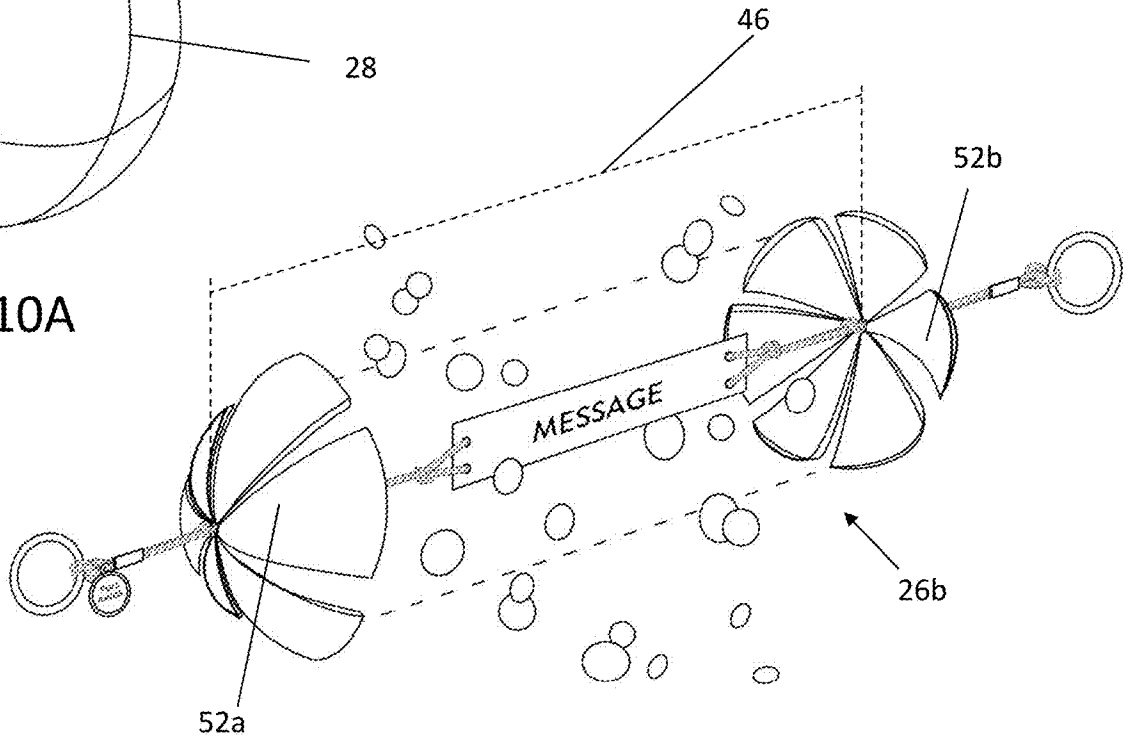
Figures 11A, 11B:
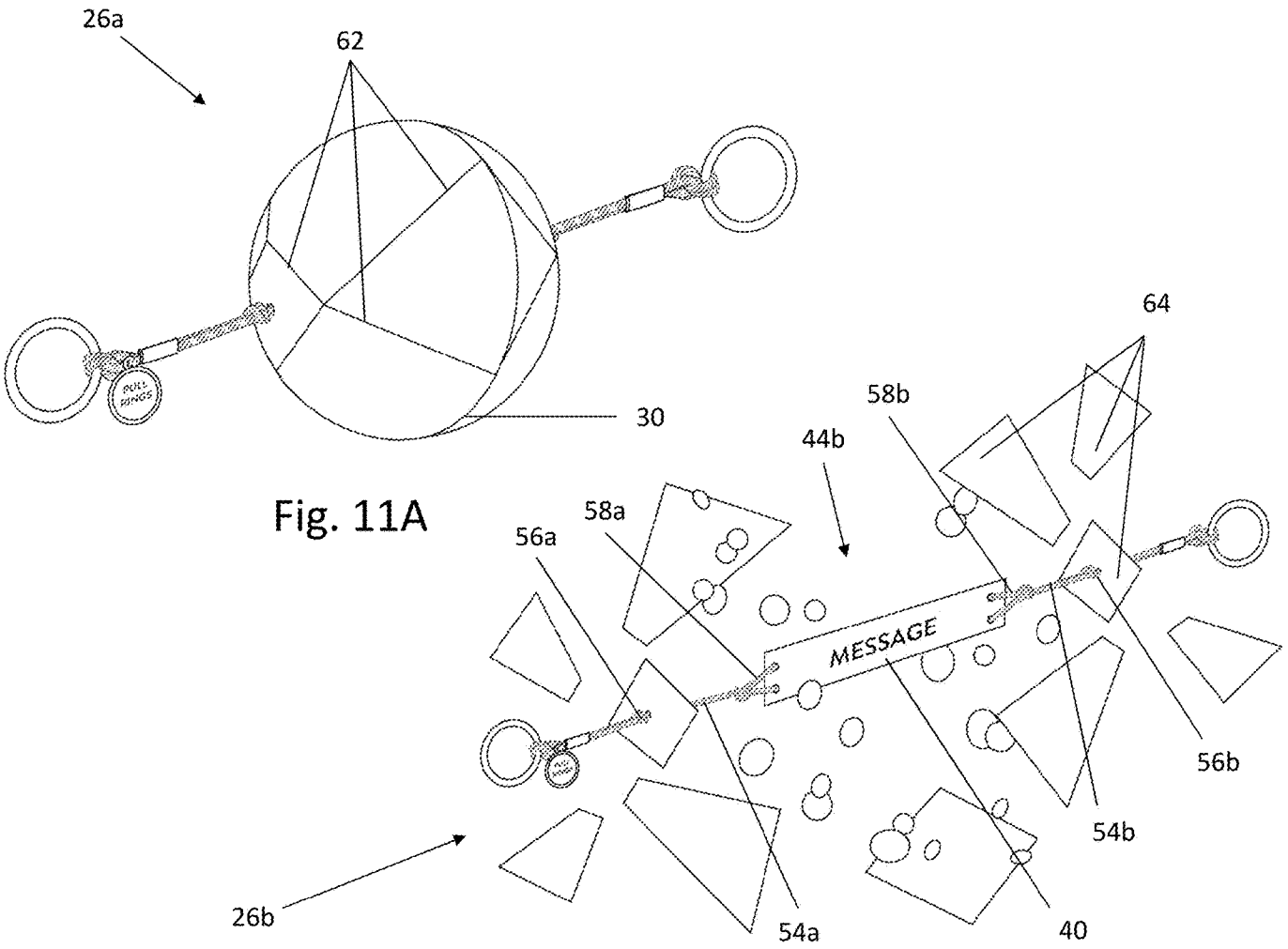
FIGS. 11A and 11B show perspective views of a container having a multiple piece construction in the closed configuration and open configuration, respectively.

FIGS. 10 and 11 show embodiments of the container where the two sections are comprised of multiple pieces. As depicted in FIG. 10, an embodiment of the container sections may have a multiple piece construction 52*a* and 52*b*, similar to an orange slice, with each piece connected at a single point. In the closed configuration, shown in FIG. 10A, the shell is sealed. When pulled apart as in FIG. 10B, each piece of the sections expands away from each other, revealing the interior of the shell. In another embodiment shown in FIG. 11, the sections are made up of multiple separable pieces that are temporally attached in the closed configuration. As shown in FIG. 11A, this embodiment when closed has multiple seams 62 between the multiple sections subsequently break apart into the multiple pieces 64 in the open configuration, shown in FIG. 11B. Regardless of the embodiment, the message is still revealed in the open configuration and hidden from view in the closed configuration.

Figure 12:
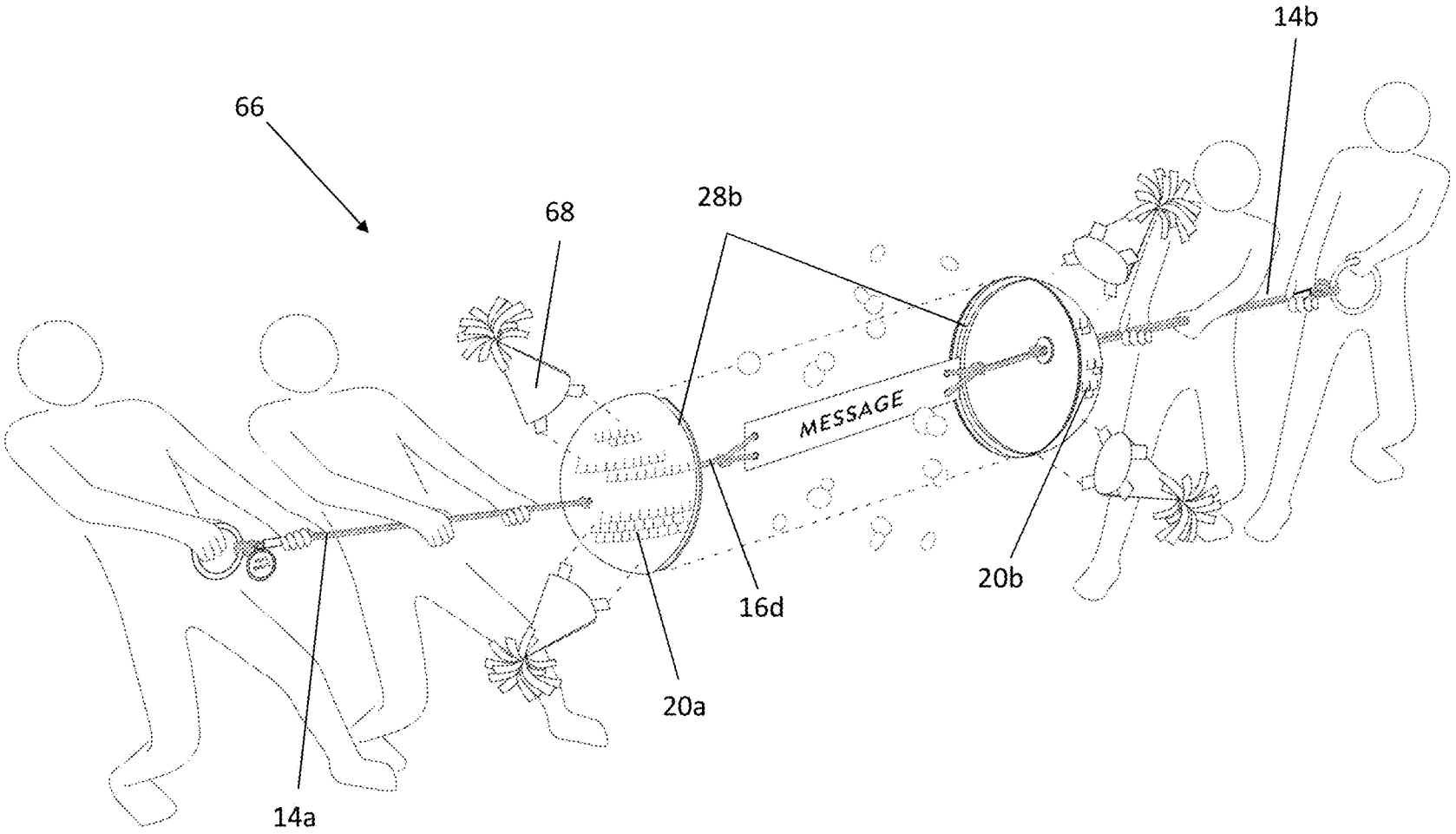
FIG. 12 shows the container according to the present invention having a large scale construction for multi-person usage.

The container can also come in a variety of sizes. FIG. 12 illustrates a large scale construction 66 of the container where multiple people can use the pull grips to pull apart the two sections and reveal the interior message. Additionally, the shell form does not have to be created by one specific material as long as it functions the same way and the cording system can be threaded through; it can be molded with rigid 34 or pliable plastic, metal, wood, etc. Furthermore, the aesthetic details of the metal hardware are interchangeable, as long as it provides the same utility function of providing an easy pull system and providing finishing touches to the cord ends. The decorative exterior materials 68 are also interchangeable and may evolve over time, as using paper to create the fringe and tassels are not required for the piñata to function. Paper coverings and components may be replaced with paints, printed inks, fabrics, and/or plastic decorative details, as these materials are not determinative of the function of the innovative construction.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claim is:

1. A container for holding a message, comprised of:

a shell comprised of a first section and a second section, wherein the first section and the second section are positioned on opposite sides of the shell, wherein the shell has an exterior surface and an interior surface, wherein the shell surrounds an interior cavity in a closed configuration and reveals the interior surface in an open configuration, wherein the first section and the second section are connected to each other at an interface in the closed configuration and are disconnected from each other in the open configuration;

a first pull-grip, wherein the first pull-grip is connected to the first section;

a second pull-grip, wherein the second pull-grip is connected to the second section, and wherein a tension between the first pull-grip and the second pull-grip when the shell is in its closed configuration forces the shell into the open configuration;

a connector within the shell in the closed configuration and exposed between the first section and the second section in the open configuration, wherein the connector has a first end and a second end on opposite sides of a message holder, and wherein the message holder comprises a folded orientation in the closed configuration and an unfolded orientation in the open configuration;

a first mount positioned within the interior cavity and connected between the first end of the connector and at least one of the first section and the first pull-grip; and a second mount positioned within the interior cavity and connected between the second end of the connector and at least one of the second section and the second pull-grip.

2. The container of claim 1, wherein the first pull-grip and the second pull-grip extend away from the exterior surface.

3. The container of claim 1, wherein the shell is comprised of a rigid material, wherein the connector is flexible, wherein the message holder comprises at least one of a pliable elongated strip displaying the message and a plurality of rigid pieces displaying the message, wherein the pliable elongated strip and the plurality of rigid pieces have a folded length less than an interior dimension of the cavity of the container in the folded orientation, and wherein the pliable elongated strip and the plurality of rigid pieces have an unfolded length in the unfolded orientation that is at least twice the folded length.

4. The container of claim 1, wherein the shell is pliable with a flat configuration and an expanded configuration, and wherein the interior cavity in the expanded configuration has a volume greater than the flat configuration.

5. The container of claim 1, wherein a seam is configured to cover the interface in the closed configuration.

6. The container of claim 1, wherein the first section and the second section are connected at the interface in the closed configuration, wherein the interface is a joint selected from the group consisting of a cover, a rim, a magnet, a plurality of pegs, a plurality of fasteners, and a perforation.

7. The container of claim 3, wherein the first pull-grip and the second pull-grip is comprised of a pull-ring and a cord, and wherein the message is selected from at least one of the group of messages consisting of a 2D message, a 3D message, a rewritable message, an insertable message, a transferable message, an audio message, a photograph, a slap-bracelet, a beaded message, a jewelry bar, a charm, an edible message, a locket, and a detachable message.

8. The container of claim 1, wherein the connector is at least one of a string and a chain having a bunched configuration and an extended configuration, wherein the bunched configuration fits within the interior cavity in the closed configuration, wherein the extended configuration has a longitudinal distance greater than a size of the internal cavity, wherein the connector is in the bunched configuration when the shell is in the closed configuration, and wherein the connector is in the extended configuration when the shell is in the open configuration.

9. The container of claim 1, wherein the shell is further comprised of a slit, wherein the slit is configured to allow access to the message in the closed configuration.

10. The container of claim 1, wherein the first section is further comprised of a first multiple piece construction and the second section is further comprised of a second multiple piece construction.

11. The container of claim 1, wherein the connector is further comprised of a first segment and a second segment on opposite sides of the message holder, wherein the first segment is proximate to the first end of the connector and is attached to the first mount at a proximate end of the first segment, wherein the second segment is proximate to the second end of the connector and is attached to the second mount at a proximate end of the second segment, and wherein the message holder is affixed between a pair of distal ends of the first segment and the second segment.

12. A container for holding a message, comprised of:

a shell comprised of a first section and a second section, wherein the first section and the second section are positioned on opposite sides of the shell, wherein the shell has an exterior surface and an interior surface, wherein the shell surrounds an interior cavity in a closed configuration and reveals the interior surface in an open configuration, wherein the first section and the second section are connected to each other at an interface in the closed configuration and are disconnected from each other in the open configuration;

a first pull-grip, wherein the first pull-grip is connected to the first section;

a second pull-grip, wherein the second pull-grip is connected to the second section, and wherein a tension between the first pull-grip and the second pull-grip when the shell is in its closed configuration forces the shell into the open configuration;

a connector comprised of a first segment, a second segment and a message holder, wherein the connector has a bunched configuration and an extended configuration, wherein the connector is bunched and within the shell in the closed configuration and exposed and extended between the first section and the second section in the open configuration, wherein the connector has a first end and a second end on opposite sides of the connector, wherein the message holder is attached to the connector between the first segment and the second segment, wherein the message holder comprises a folded orientation in the closed configuration and an unfolded orientation in the open configuration, and wherein the message holder is positioned within the interior cavity;

a first mount positioned within the interior cavity and connected between the first end of the connector and at least one of the first section and the first pull-grip; and a second mount positioned within the interior cavity and connected between the second end of the connector and at least one of the second section and the second pull-grip.

13. The container of claim 12, wherein the first segment is proximate to the first end of the connector and is attached to the first mount at a proximate end of the first segment, wherein the second segments is proximate to the second end of the connector and is attached to the second mount at a proximate end of the second segment, wherein the message holder is affixed between a pair of distal ends of the first segment and the second segment, wherein the bunched configuration has a bunched dimension less than an interior dimension of the cavity of the container, and wherein the extended configuration has an extended longitudinal distance greater than a diameter of the cavity.

14. The container of claim 12, wherein the first section is further comprised of a first multiple piece construction and the second section is further comprised of a second multiple piece construction, wherein the multiple piece constructions are comprised of a plurality of separable pieces, wherein the pieces are connected adjacently in the closed configuration, and wherein the pieces are disconnected in the open configuration.

15. The container of claim 13, wherein the message holder is further comprised of at least one of a pliable elongated strip displaying the message and a plurality of rigid pieces displaying the message, wherein the pliable elongated strip and the plurality of rigid pieces have a folded length less than the interior dimension of the cavity of the container in the folded orientation, wherein the pliable elongated strip and tile plurality of rigid pieces have an unfolded length in the unfolded orientation that is at least twice the folded length, wherein the message is hidden from view in the closed arrangement, and wherein the message is exposed in the open configuration.

16. The container of claim 12, wherein the shell is pliable with a flat configuration and an expanded configuration, and wherein the interior cavity in the expanded configuration has a volume greater than the flat configuration.

17. A container for holding a message, comprised of:

a shell comprised of a first section and a second section, wherein the first section and the second section are positioned on opposite sides of the shell, wherein the shell has an exterior surface and an interior surface, wherein the shell surrounds an interior cavity in a closed configuration and reveals the interior surface in an open configuration, wherein the first section and the second section are connected to each other at an interface in the closed configuration and are disconnected from each other in the open configuration;

a first pull-grip, wherein the first pull-grip is connected to the first section;

a second pull-grip, wherein the second pull-grip is connected to the second section, and wherein a tension between the first pull-grip and the second pull-grip when the shell is in its closed configuration forces the shell into the open configuration;

a flexible connector comprised of a first segment, a second segment and a message holder, wherein the connector has a bunched configuration and an extended configuration, wherein the connector is bunched and within the shell in the closed configuration and exposed and extended between the first section and the second section in the open configuration, wherein the bunched configuration has a bunched dimension less than an interior dimension of the cavity of the container, wherein the extended configuration has an extended longitudinal distance greater than a diameter of the cavity, wherein the connector has a first end and a second end on opposite sides of the connector, wherein the first segment is proximate to the first end of the connector wherein the second segments is proximate to the second end of the connector, wherein the message holder is affixed between a pair of distal ends of the first segment and the second segment, wherein the message holder comprises a pliable elongated strip and a plurality of rigid pieces displaying a message, wherein the message holder comprises a folded orientation in the closed configuration and an unfolded orientation in the open configuration, wherein the pliable elongated strip and the plurality of rigid pieces have a folded length less than the interior dimension of the cavity of the container in the folded orientation, and wherein the pliable elongated strip and the plurality of rigid pieces have an unfolded length in the unfolded orientation that is at least twice the folded length;

a first mount positioned within the interior cavity and connected between the first segment of the connector and at least one of the first section and the first pull-grip; and a second mount positioned within the interior cavity and connected between the second segment of the connector and at least one of the second section and the second pull-grip.

18. The container of claim 17, wherein the first pull-grip and the second pull-grip extend away from the exterior surface.

19. The container of claim 17, wherein the first section is further comprised of a first multiple piece construction and the second section is further comprised of a second multiple piece construction, wherein the multiple piece constructions are comprised of a plurality of separable pieces, wherein the pieces are connected adjacently in the closed configuration, and wherein the pieces are disconnected in the open configuration.

20. The container of claim 17, wherein the message is hidden from view in the closed arrangement, wherein the message is exposed in the open configuration, wherein the message is selected from at least one of the group consisting of a 2D message, a rewritable message, an insertable message, a transferable message, an audio message, a photograph, a 3D message, a slap-bracelet, a beaded message, a jewelry bar, a charm, an edible message, a locket, and a detachable message.

* * * * *